US007731599B1

(12) United States Patent
Caserta et al.

(10) Patent No.: US 7,731,599 B1
(45) Date of Patent: Jun. 8, 2010

(54) GUIDE ASSEMBLY FOR A GOLF PUTTER AND ITS ASSOCIATED METHOD OF USE

(76) Inventors: Richard M. Caserta, 11 N. 2nd St., Apt. 503, Philadelphia, PA (US) 19106; Gerald G. Giraldi, 323 D'Arcy Ave., Trenton, NJ (US) 08629

( * ) Notice: Subject to any disclaimer, the term of this patent is extended or adjusted under 35 U.S.C. 154(b) by 355 days.

(21) Appl. No.: 11/803,164

(22) Filed: May 14, 2007

Related U.S. Application Data

(63) Continuation-in-part of application No. 11/438,985, filed on May 24, 2006, now Pat. No. 7,556,569, which is a continuation-in-part of application No. 11/027,597, filed on Jan. 3, 2005, now Pat. No. 7,104,899, which is a continuation-in-part of application No. 10/828,618, filed on Apr. 22, 2004, now Pat. No. 7,104,898.

(51) Int. Cl.
*A63B 69/36* (2006.01)

(52) U.S. Cl. ..... 473/236; 473/238; 473/244; 473/251

(58) Field of Classification Search ..... 473/219–256
See application file for complete search history.

(56) References Cited

U.S. PATENT DOCUMENTS 1,536,512 A * 5/1925 McLaren ..... 473/238
3,198,525 A * 8/1965 Smith ..... 473/238
3,273,893 A * 9/1966 Duncan ..... 473/238
3,667,761 A 6/1972 Palotsee ..... 273/186
3,917,277 A * 11/1975 Beck et al. ..... 473/244
5,447,313 A 9/1995 Finley ..... 273/187.4
5,551,695 A 9/1996 Wolk ..... 473/236
7,104,898 B1 * 9/2006 Caserta ..... 473/236
7,104,899 B1 * 9/2006 Caserta ..... 473/236
7,556,569 B1 * 7/2009 Caserta ..... 473/236

* cited by examiner

*Primary Examiner*—Sebastiano Passaniti
(74) *Attorney, Agent, or Firm*—LaMorte & Associates

(57) ABSTRACT

A putting guide assembly and its associated method of use. The putting guide assembly attaches to the head of a putter. The putter head has a striking surface for striking a golf ball. The putting guide assembly is attached to the putter and presents a flexible guide surface that extends forward of the putter's striking surface. The flexible guide surface can be configured into different curvatures. As the flexible guide surface is adjusted, the perceived curvature observed by a golfer holding the putter changes. A golfer can therefore selectively change the perceived curvature to match the natural curvature inherent in that golfer's putting swing.

11 Claims, 5 Drawing Sheets

GUIDE ASSEMBLY FOR A GOLF PUTTER AND ITS ASSOCIATED METHOD OF USE

RELATED APPLICATIONS

This application is a continuation-in-part of co-pending patent application Ser. No. 11/438,985 filed May 24, 2006, now U.S. Pat. No. 7,556,569 entitled Detachable Guide Assembly For A Golf Putter And Its Associated Method Of Use, which is a continuation-in-part of application Ser. No. 11/027,597 filed Jan. 3, 2005, now U.S. Pat. No. 7,104,899, entitled Golf Putter With Extending Training Rail Device And Its Associated Method Of Use, which is a continuation-in-part of application Ser. No. 10/828,618, now U.S. Pat. No. 7,104,898 filed Apr. 22, 2004, entitled Golf Putter Training Device And Method.

BACKGROUND OF THE INVENTION

1. Field of the Invention

In general, the present invention relates to the structure of putters that are used in playing the game of golf. More particularly, the present invention is directed toward golf putters with secondary visual and/or tactile aids that can be used in developing a proper putting swing.

2. Description of Related Art

In the game of golf, the object of the game is to hit a golf ball into a distant golf hole with as few strokes of a golf club as possible. In golf, the hole is positioned on a green of finely manicured grass. When a golf ball lands on the green, it is most commonly struck toward the hole with a putter. A putter is a golf club that has a generally flat striking surface. Thus, when a golf ball is struck with the putter, the golf ball tends to roll forward on the green rather than fly up into the air.

The prior art is replete with many different designs for putters and putter heads. In this collection of designs, there exist many golf putters that have features that are intended to help a golfer practice proper putting techniques.

When a golfer putts, the golfer wants to strike the golf ball flush in the center of the putter, without having the putter experience any lateral movement relative the ball. That is, the head of the putter should only be traveling in the exact direction the golfer wants the golf ball to travel when the putter strikes the golf ball. In order to consistently putt in this manner, a golfer must practice his putting and his golf swing with the putter.

In the prior art, golf putters have been created that contain guide rods. The guide rods extend from the golf putter and provide a visual and/or tactile reference guide that can be used to practice putting. For example, in U.S. Pat. No. 5,447,313, to Finley, entitled Golf Putter With Foldable Aiming Device, a putter is shown having a rod that extends behind the face of the putter at a perpendicular. The rod provides a visual alignment tool for a golfer practicing putting. By aligning the rod with the golf ball and keeping the rod in alignment with the golf ball throughout the putter's swing, a person can train himself/herself to properly swing the putter.

In U.S. Pat. No. 3,667,761, to Palotsee, entitled Golf Putter With Aligning Device, another putter is shown that uses a rod as a visual aid. In this patent, the rod extends out in front of the putter's face and passes over the top of a golf ball as the putter strikes the golf ball. Again, the rod provides a visual alignment tool to a person practicing putting. By aligning the rod with the golf ball and keeping the rod in alignment with the golf ball throughout the putter's swing, a golfer can train himself/herself to properly swing the putter.

In U.S. Pat. No. 5,551,695, to Wolk, entitled Apparatus For Training A Golfer To Properly Putt A Golf Ball, yet another putter design is shown that uses rods. In the Wolk design, two parallel rods extend from the front of the putter's face. The rods provide both a visual indicator and a tactile indicator for a golfer. If a golfer swings straight, the rods travel straight and the golf ball strikes the putter's face without touching the rods. If a golf swing is not straight, the rods will not travel straight and the rods will strike the golf ball.

A problem associated with prior art putters that use guide rods is that the guide rods are usually very short and straight. The guide rods are therefore only useful when the face of the golf club is very close to the golf ball. However, in reality, most golfers have a putting swing where the head of the putter travels more than a foot before it contacts the golf ball. Prior art guide rods are only a few inches long. Thus, short guide rods are not useful guides throughout most of the putting swing. Furthermore, many golfers have a putting swing that curves slightly as they rotate. Thus, the head of the putter moves along a slightly curved path as the putter head travels toward the golf ball. In the prior art, guide rods are straight. Prior art guide rods, therefore, do not always accurately align with the path of travel of the putter and can often cause a golfer to misalign a putt.

A need therefore exists for a golf putter that provides a long, curved guide rod that acts as an accurate visual and tactile reference throughout an entire putting swing. This need is met by the present invention as it is described and claimed below.

SUMMARY OF THE INVENTION

The present invention is a putting guide assembly and its associated method of use. The putting guide assembly attaches to the head of a putter. The putter head has a striking surface for striking a golf ball. The putting guide assembly is attached to the putter and presents a flexible guide surface that extends forward of the putter's striking surface. The flexible guide surface comes with a manual adjustment that enables the flexible guide surface to be selectively configured into shapes of varying curvatures.

As the curvature of the flexible guide surface is changed, the perceived curvature observed by a golfer holding the putter changes. A golfer can therefore selectively change the perceived curvature of the flexible guide surface to match the natural curvature inherent in that golfer's putting swing. The flexible guide surface, therefore, presents a visual and tactile guide to the golfer that helps the golfer create straight putts, even if the golfer's putting motion produces a slightly curved movement in the travel path of the putter.

BRIEF DESCRIPTION OF THE DRAWINGS

For a better understanding of the present invention, reference is made to the following description of exemplary embodiments thereof, considered in conjunction with the accompanying drawings, in which.

DETAILED DESCRIPTION OF THE DRAWINGS

In the field of golf putters, there are many different designs and styles. The illustrated embodiments of the present invention show only one traditional putter design. It will be understood that the embodiments of the putter illustrated are merely exemplary and that the features of the present invention can be adapted for use on most any known putter design.

Figure 1:
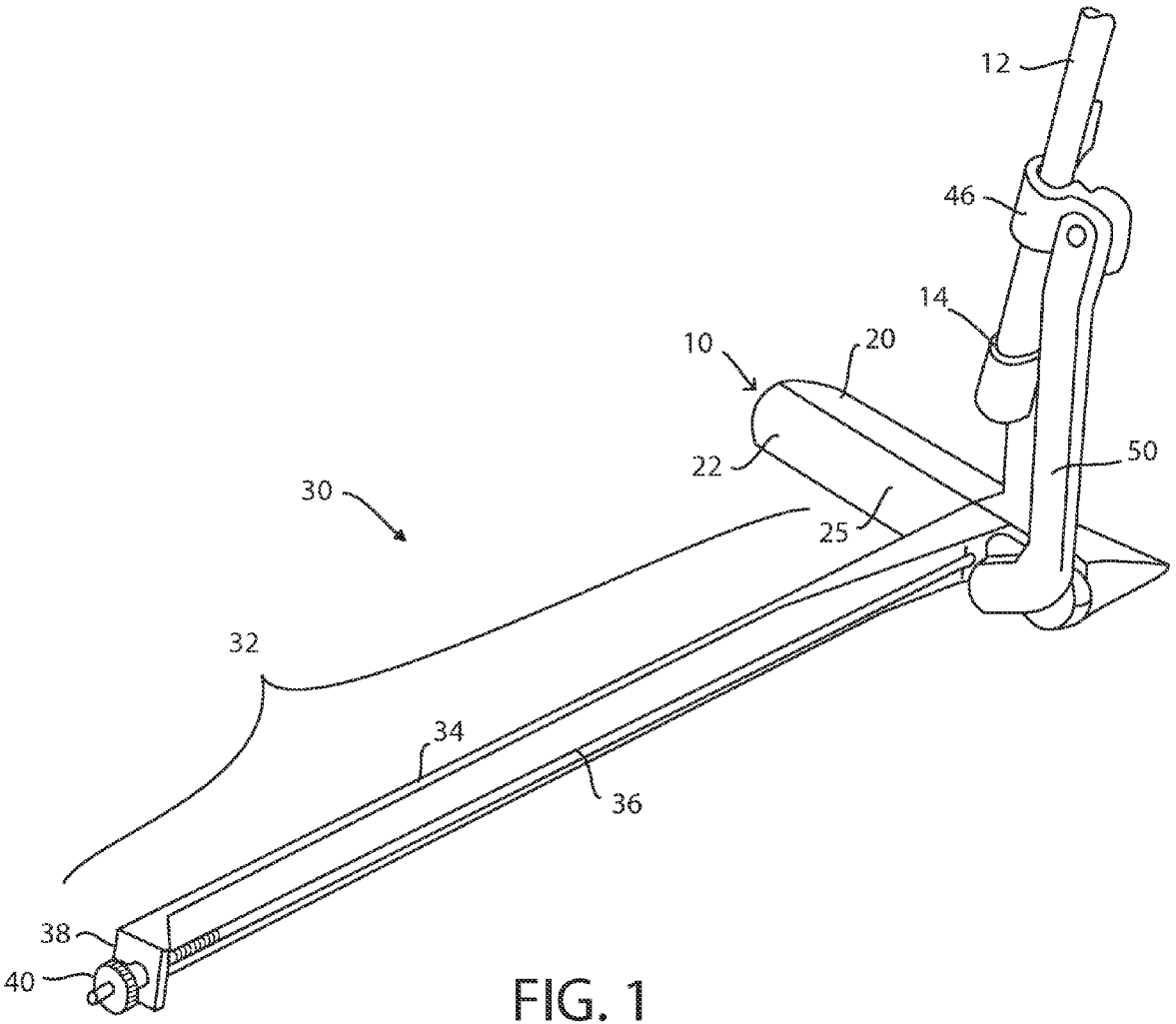
FIG. 1 is a perspective view of an exemplary embodiment of the present invention shown in an exploded fashion with a putter head.
Figure 2:
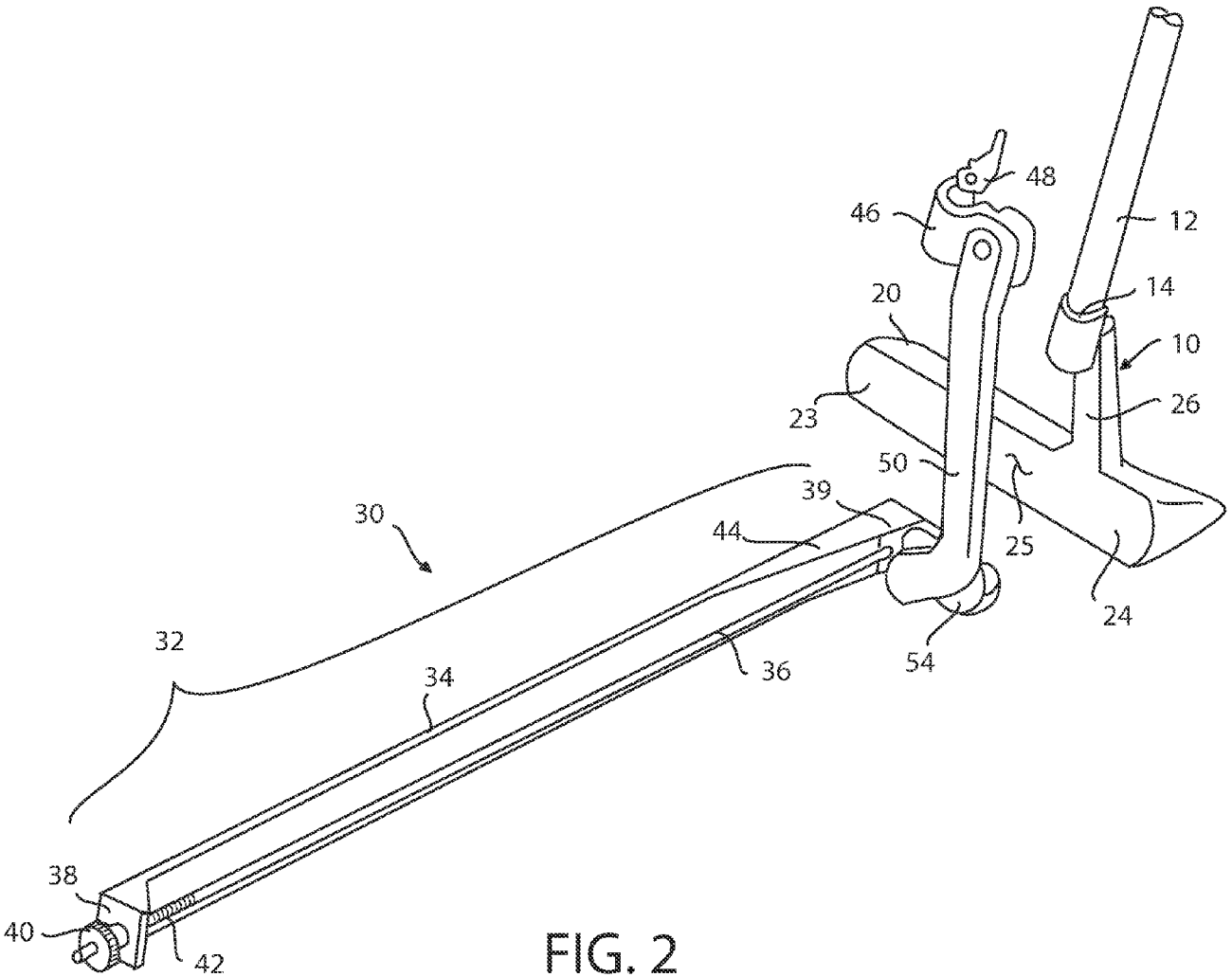
FIG. 2 is an assembled view of the components of FIG. 1.

Referring to FIG. 1 and FIG. 2, there is shown a putter 10. The putter 10 has a shaft 12 with a bottom end 14. The top end of the shaft 12 terminates with a grip handle (not shown) in a traditional manner. A putter head 20 is disposed at the bottom end 14 of the shaft 12. The putter head 20 has a generally flat striking surface 22 that is used to strike a golf ball when putting.

A putt training assembly 30 is provided. The putt training assembly 30 attaches to the putter 10. The putt training assembly 30 contains a swing guide 32 that can be selectively altered into a variety of curvatures. When attached to the putter 10, the swing guide 32 extends forward from the flat striking surface 22 of the putter head 20.

The putter head 20 has a toe section 23, a heel section 24 and a central section 25 disposed in between the toe section 23 and the heel section 24. Ideally, a golfer wants to strike a golf ball with the central section 25 of the striking surface 22. It is also desired that the plane of the striking surface 22 be perfectly perpendicular to the desired line of travel for the golf ball at the moment of impact.

The shown embodiment of a putter 10 also shows a vertical leg 26 that extends upwardly from the putter head 20. The vertical leg 26 attaches the putter head 20 to the shaft 12 of the putter 10.

As has been previously mentioned, the putt training assembly 30 contains a swing guide 32. The swing guide 32 is a subassembly that includes a flat flexible face surface 34. Rod mounts 38, 39 are attached to each end of the flexible face surface 34. A rod 36 is provided that spans the distance between the two rod mounts 38, 39 behind the flexible face surface 34. Accordingly, the rod 36 extends the length of the flexible face surface 34.

The rod 36 has a threaded section 42 that extends through the rod mount 38 on the proximal end of the swing guide 32. An adjustment knob 40 is provided that engages the threaded section 42 of the rod 36. Normally, the flexible face surface 34 is straight. However, when the adjustment knob 40 is tightened, the adjustment knob 40 compresses the flexible face surface 34. As the flexible face surface 34 is compressed, it bends. Reinforcements 44 are provided along the flexible face surface 34 that cause the flexible face surface 34 to bend in a predictable and controlled manner. As the adjustment knob 40 is tightened on the rod 36, the flexible face surface 34 bends inwardly toward the rod 36. The result is that the flexible face surface 34 changes from a straight surface to a concave surface. The degree of curvature is directly proportional to the degree of compression. It will therefore be understood that as the adjustment knob 40 is tightened, the flexible face surface 34 curves only slightly. As the adjustment knob 40 is further tightened, the curvature of the flexible face surface 34 increases proportionally.

The putt training assembly 30 connects to the putter 10 with a mounting clamp 46. The mounting clamp 46 is shaped and sized to engage the shaft 12 of the putter 10 just above the vertical leg 26 of the putter head 20. The mounting clamp 46 has a toggle lock 48 that enables the mounting clamp 46 to be selectively opened and closed. Accordingly, it will be understood that the mounting clamp 46 of the putt training assembly 30 can be selectively attached and detached from the putter 10.

The mounting clamp 46 is attached to a bracket 50 with an adjustable hinge connection 52. The adjustable hinge connection 52 enables the mounting clamp 46 to adjust in position to engage the varied slopes of different types of putters. The bracket 50 extends generally downwardly to a position in front of the heel section 24 of the striking surface 22. At the bottom of the bracket 50, a lateral extension 54 connects the bracket 50 to the swing guide 32. When the mounting clamp 46 is engaged with the putter shaft 12, the bracket 50 and lateral extension 54 combine to join the swing guide 32 to the putter 10 so that the swing guide 32 extends at a perpendicular from the striking surface 22 of the putter 10. In the shown embodiment, the swing guide 32 extends in front of the heel section 24 of the striking surface 22. However, it should be understood that in an alternate embodiment, the swing guide 32 can be supported in front of the toe section 23 of the striking surface 22.

Figure 3:
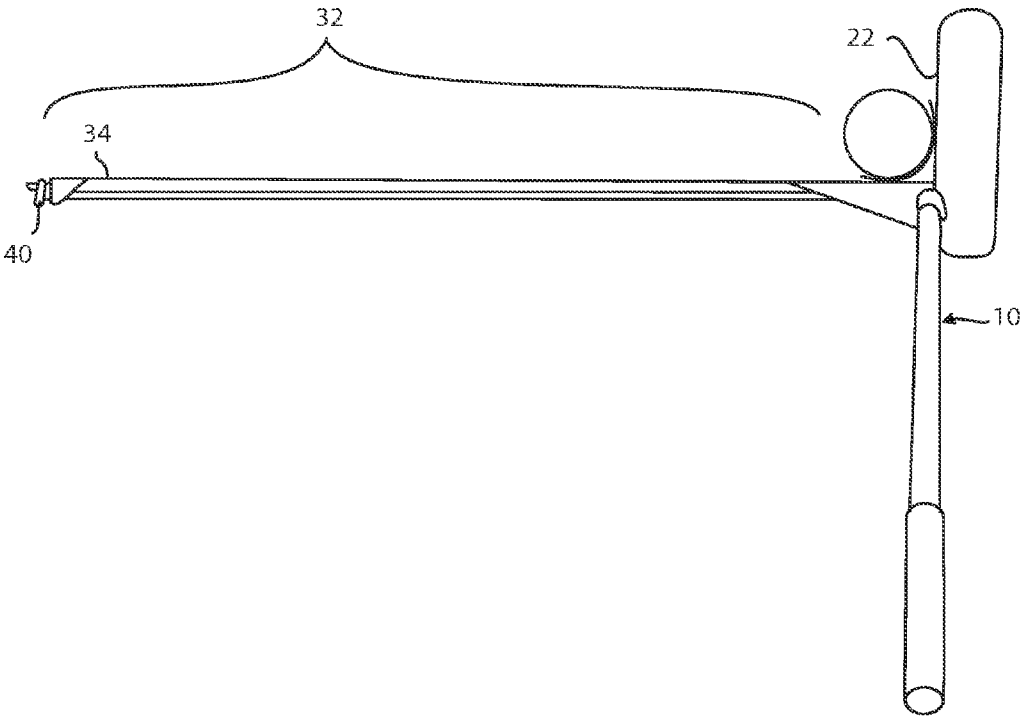
FIG. 3. is a top view of a putter head connected to a training rod presenting a straight shape.

Referring to FIG. 3, the swing guide 32 is shown having a straight flexible face surface 34. Such a configuration is obtained by loosening the adjustment knob 40 to a point where it does not compress the flexible face surface 34. The flexible face surface 34 in normally straight and returns to its normal straight position when unstressed. The golfer looking down at the flexible face surface 34 would view the flexible face surface 34 as a straight line. Such an orientation is used by golfers that have a straight swing.

Figure 4:
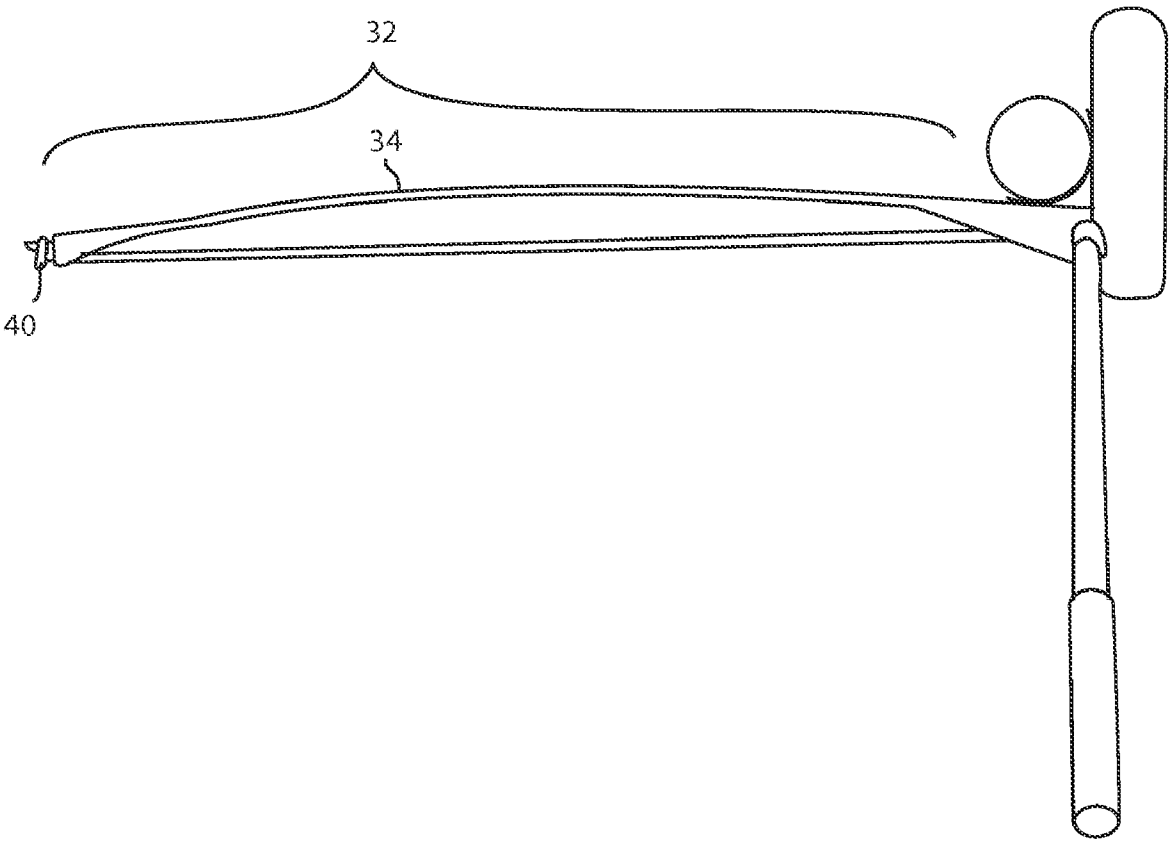
FIG. 4 is a top view of a putter head connected to a training rod presenting a curved shape.

However, as is shown by FIG. 4, the adjustment knob 40 on the swing guide 32 can be tightened. This causes the flexible face surface 34 to buckle and bend into a concave shape. Accordingly, a golfer looking down at the flexible face surface 34 will observe a curved line.

Returning to FIG. 2, it will be understood that the degree of curvature in the flexible face surface 34 is dependent upon the degree that the adjustment knob 40 is used to compress the flexible face surface 34. Consequently, the swing guide 32 can be selectively adjusted into most any curvature desired by a golfer.

In the shown embodiment, the putt training assembly 30 that supports the swing guide 32 is attached to the shaft 12 of the putter 10. This supports the swing guide 32 in front of the striking surface 22 of the putter 10. However, it will be understood that the swing guide 32 can pass along the top of the putter head 20 or attach to other parts of the putter 10. The point of attachment is not of great importance. Rather, what is of importance is that the swing guide 32 extends forward of the putter head 20 and that the swing guide 32 can be selectively rotated and viewed from above when putting.

To use the putter 10, a golfer selects a putt training assembly 30 with a swing guide 32 having a length at least as long as the putting swing that the golfer wants to practice. The putt training assembly 30 is attached to the putter head 20 and the swing guide 32 is adjusted so that the curvature of the swing guide 32 that is observed by the golfer matches the natural curvature of the golfer's putting stroke. The perceived curvature of the flexible face surface 34 on the swing guide 32 can be selectively changed by tightening or loosening the adjustment knob 40 on the swing guide 32. In this manner, the swing guide 32 can be made to complement the natural swing of the golfer.

Optionally, the swing guide 32 can be color-coded in various sections along its length. Depending on the golfer's swing and how far of a putt is to be made, a golfer can use the colored sections to gauge the path of the putter 10.

Figure 5:
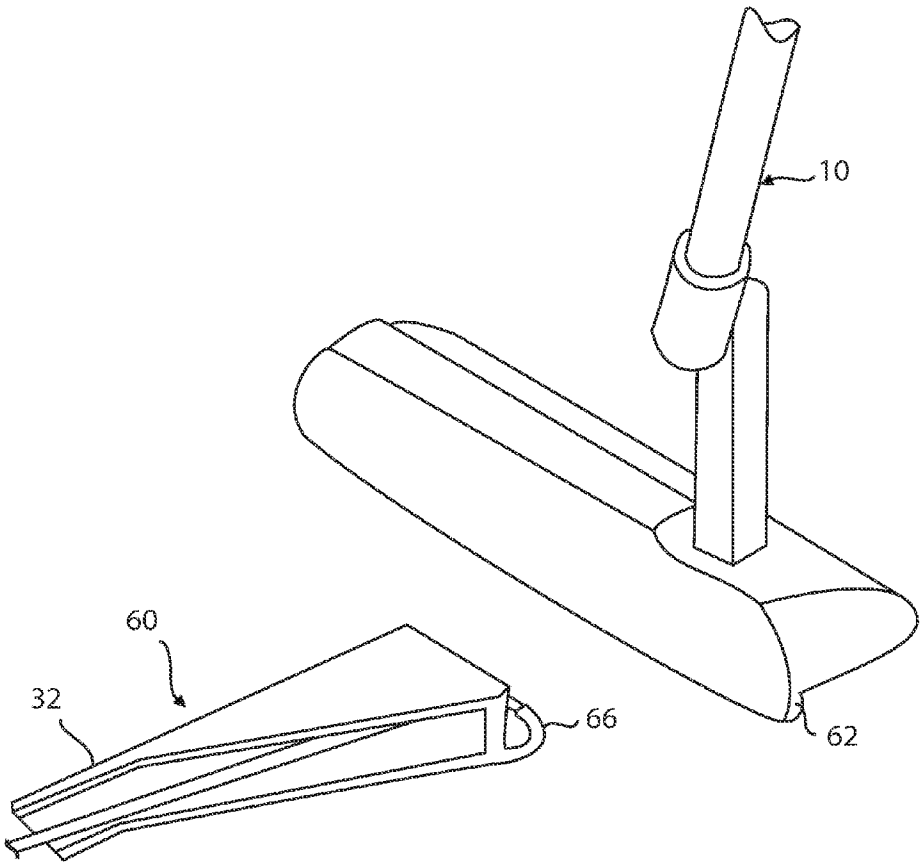
FIG. 5 is a perspective view of an alternate embodiment of the present invention with the training rod engaging a golf ball.

Referring to FIG. 2 in conjunction with FIG. 5, it can be seen that the swing guide 32 extends from the striking surface 22 of the putter head 20 in the heel section 24 of the putter head 20. The swing guide 32 is positioned so that the flexible face surface 34 will just contact the side of a golf ball when the golf ball strikes the exact center of the striking surface 22. If a golfer putts correctly, the flexible face surface 34 skims along the side of a golf ball at a tangent. The swing guide 32 acts as both a physical and optical guide that helps a golfer swing a putter and contact a golf ball with the exact center of the putter. A golfer may have a slight curve in his/her swing. The flexible face surface 34 is adjusted in curvature so that it matches this natural curvature.

If a golfer twists the putter 10 during a putt, the flexible face surface 34 will either move away from the golf ball or push the golf ball off-line. It will therefore, be understood that the flexible face surface 34 will only touch the tangent edge of the golf ball, if a golfer is using a correct swing.

With most golfers, the error that occurs in their putting swing is that the golf ball travels toward the heel section 24 of the putter head 20 during the swing. It is for this reason that the shown embodiment has the swing guide 32 in the heel section 24 of the putter head 20. However, if a golfer has the opposite problem, a golfer can use the embodiment of the present invention putter 10 where the swing guide 32 extends from the toe section 23 of the putter head 20.

In either embodiment, it is preferred that only one swing guide 32 extend from the striking surface 22 of the putter head 20. If two swing guides were used, a golfer would have to approach the golf ball in an unusual manner and lower the golf club over the golf ball so that the swing guides do not touch the golf ball. This would cause the approach to the golf ball during training to be different from the approach of the golf ball during regulation play. By using only a single swing guide 32, a golfer can move the putter 10 laterally next to the golf ball and therefore approach a golf ball in the same manner they would if the swing guide were not present. This creates consistency between training to putt and actually putting during a game.

There are many types of putters. Not all putters have necks and/or shafts that are conveniently configured for use in attaching a swing guide. Referring to FIG. 5, an alternate embodiment of a putt training assembly 60 is shown. Components in the alternate embodiment that are the same as in previous embodiments will be identified with the same reference numbers to avoid confusion.

In the embodiment of FIG. 5, the striking face 22 of the putter 10 is created with an overextending bottom flange 62. A putt training assembly 60 is provided having a swing guide 32 that functions in the manner previously described. Rather than attaching the swing guide 32 to a bracket that connects to the putter shaft, the swing guide 32 contains a locking slide 66. The locking slide 66 is sized to pass over the striking surface 22 of the putter 10. The locking slide 66 engages the flange 62 on the putter 10, therein mechanically connecting the swing guide 32 to the putter 10. The swing guide 32 extends forward in front of the striking surface 22 of the putter 10 and functions in the same manner as has been previously described.

It will be understood that the embodiments of the putting guide assembly that have been described and illustrated are merely exemplary and that a person skilled in the art can make many variations to those embodiments. For example, the shape of the putter head can be varied to match most any known design. The method of attaching the swing guide to the putter head can be varied from the configurations shown. Furthermore, it will be understood that the swing guide can be manufactured as part of the putter and need not be a removable part. All such variations, modifications and alternate embodiments are intended to be covered by the scope of the present invention as defined by the claims.

What is claimed is:

1. A golf club assembly, comprising:

a shaft;

a club head coupled to one end of said shaft, wherein said club head contains a striking surface for striking a gold ball;

a flexible guide surface extending in front of said striking surface of said club head;

a threaded rod; and an adjustment knob that screws along said threaded rod, wherein said adjustment knob compresses said flexible guide surface and causes it to bend when said adjustment knob is tightened along said threaded rod.

2. The assembly according to claim 1, wherein said flexible guide surface is anchored to said club head.

3. The assembly according to claim 2, wherein said flexible guide surface is selectively detachable from said club head.

4. The assembly according to claim 1, wherein said flexible guide surface is anchored to said shaft.

5. The assembly according to claim 4, wherein said flexible guide surface is selectively detachable from said shaft.

6. The assembly according to claim 1, wherein said flexible guide surface is reinforced and embodies a predictable change in curvature when compressed in different amounts.

7. A method of altering a configuration of a golf putter for use in training, said method comprising the steps of:

providing a putter having a striking face for striking a golf ball;

providing a flexible guide surface;

providing a threaded rod;

providing an adjustment knob that screws along said threaded rod, wherein said adjustment knob compresses said flexible guide surface and causes it to bend when said adjustment knob is tightened along said threaded rod; and attaching said flexible guide surface to said putter so that said flexible guide surface extends forward of said striking face.

8. The method according to claim 7, wherein said step of attaching said flexible guide surface to said putter includes suspending said flexible guide surface in front of said striking face of said putter.

9. The method according to claim 7, wherein said step of suspending said flexible guide surface in front of said striking face of said putter includes attaching said flexible guide surface to a mounting clamp and attaching said mounting clamp to said putter.

10. The assembly according to claim 9, wherein said mounting clamp is selectively attachable and detachable from said putter.

11. The method according to claim 7, wherein said flexible guide surface has a length of between six inches and three feet.

* * * * *